US006535181B2

(12) United States Patent
Takimoto et al.

(10) Patent No.: US 6,535,181 B2
(45) Date of Patent: Mar. 18, 2003

(54) ANTENNA SYSTEM AND METHOD FOR MANUFACTURING THE SAME

(75) Inventors: Atsushi Takimoto, Tokyo (JP); Mikio Yamashita, Tokyo (JP); Masashi Ura, Tokyo (JP); Noboru Kawaguchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 30 days.

(21) Appl. No.: 09/799,565

(22) Filed: Mar. 7, 2001

(65) Prior Publication Data

US 2002/0027529 A1 Mar. 7, 2002

(30) Foreign Application Priority Data

Sep. 6, 2000 (JP) ..... 2000-269765

(51) Int. Cl.[7] ..... H01Q 15/14
(52) U.S. Cl. ..... 343/912; 349/113; 362/31
(58) Field of Search ..... 343/781 R, 781 P, 343/781 CA, 840, 912; 349/62, 63, 65, 113; 362/26, 27, 31; H01Q 15/14

(56) References Cited

U.S. PATENT DOCUMENTS 5,649,754 A * 7/1997 Matsumoto ..... 362/31
5,764,315 A * 6/1998 Yokota et al. ..... 349/62
5,841,496 A * 11/1998 Itoh et al. ..... 349/113

FOREIGN PATENT DOCUMENTS

JP 60-189115 12/1985
JP 62-131611 6/1987

* cited by examiner

*Primary Examiner*—Tho Phan
(74) *Attorney, Agent, or Firm*—Oblon, Spivak, McClelland, Maier & Neustadt, P.C.

(57) ABSTRACT

According to an aspect of the present invention, an antenna system comprises: an antenna panel (1) which has fine irregularities (4) on front and back surfaces thereof, the fine irregularities (4) being formed by blasting so as to regularly reflect service radio waves having longer wavelength than sunlight and scatter sunlight. Further, according to another aspect of the present invention, a method for manufacturing an antenna system in which an antenna panel (1) is manufactured by combining a plurality of constituent parts, comprises the steps of: finishing front and back surface portions of each of the constituent parts so as to thin down the thickness of constituent parts; blasting the front and back surface portions of the constituent parts with abrasive grains; combining the plurality of constituent parts subjected to the blasting step so as to form the antenna panel (1) into a desired shape; and attaching an assistant reflecting mirror (3) to the antenna panel (1) acting as a main reflecting mirror.

8 Claims, 7 Drawing Sheets

ANTENNA SYSTEM AND METHOD FOR MANUFACTURING THE SAME

BACKGROUND OF THE INVENTION

The present invention relates to a millimeter-wave antenna system in which the influence of sunlight collected near a focal point of an antenna is reduced, and relates to a method for manufacturing such an antenna system.

As such a millimeter-wave antenna system, hitherto there is an antenna system which has a configuration shown in FIG. 10. FIG 10 is a schematic view of such a background-art antenna system. In FIG. 10, the reference numeral 1 represents an antenna panel; 2, a coating film painted in white or with a semi-gloss on the front surface of the antenna panel 1; and 3, an assistant reflecting mirror disposed on the coating film 2 side. Incident millimeter waves are focused on the assistant reflecting mirror 3 by the antenna panel 1. On the other hand, incident light which is shorter in wavelength than the millimeter waves (not longer than 1 $\mu$m) is not focused on the assistant reflecting mirror 3 because the incident light is irregularly reflected by the front surface of the coating film 2. However, if the frequency used in such an antenna system is higher, there is a problem that the millimeter waves passing through the inside of the coating film 2 are attenuated so that the antenna sensitivity is lowered or the observed signals to noise ratio deteriorates.

In order to solve such a problem, in the background art, for example, there is an antenna system disclosed in JP-A-62-131611. FIG. 11 is a schematic sectional view of the background-art millimeter-wave antenna system. In FIG. 11, fine irregularities 4 are formed on one of the surfaces of an antenna panel 1. In this background-art antenna system, the antenna panel 1 which has a diameter of about 50 cm and which can be used without painting is manufactured in the following method. That is, very small grooves are formed in the front surface of a flat plate, and the flat plate is bent and deformed to form the antenna panel 1. Thus, the coating film 2 is eliminated so that the antenna panel 1 can be used even in a high frequency. Further, the fine irregularities 4 are provided on the front surface of the antenna panel 1 so as to restrain light, which is reflected by the antenna panel 1, from being collected on a light collecting portion. Thus, the temperature of the light collecting portion is prevented from rising.

Thus, the aforementioned fine irregularities 4 in the background-art antenna system are formed by scratching, blasting or etching the front surface of the antenna panel 1. Aluminum plates which were 2 mm thick and which were polished on their front surfaces were used for measuring their light reflecting properties. FIG. 12 is an explanatory view for explaining the measuring method.

In the measuring method, as shown in FIG. 12, a flat-plate sample was made just opposite to the sun, and measured with an illuminometer provided with a cylinder so as to detect light only from the front, while the angle of the illuminometer with respect to the flat plate sample was changed. FIGS. 13 and 14 are graphs of the reflecting properties, respectively, of a #40 polished product and a #320 polished product. The RMS (Root Mean Square) front-surface roughness of the #40 polished product was 4.4 $\mu$m, and that of the #320 polished product was 0.7 $\mu$m. Incidentally, #40 and #320 designate the granularities (sizes) of abrasive grains respectively. The abrasive grain size becomes smaller as the number is larger. FIGS. 13 and 14 show that the illuminance was very high near the angle of 0° in each product, and light was not scattered so much. However, because it is assumed in the background-art antenna system that the diameter of the antenna panel is about 50 cm, a little effect can be generated even by such reflecting properties.

Theoretically, to what extent the reflecting properties are required is determined as follows. FIG. 15 is a relationship graph showing the relationship between the ratio of scattered light collected on an assistant reflecting mirror (450 mm) which is in a focus portion and the scatter angle (half width.), in the case of a large-size millimeter-wave parabolic antenna system which is of the order of 10 m. In this case, the energy entering a parabolic antenna is $1\times10^5$ W when the parabolic antenna is just opposite to the sun. When this energy is multiplied by the light collecting ratio and the absorptivity of the assistant reflecting mirror, the temperature rises by about 100° C. if the light collecting ratio is 0.015. Such temperature rising is considered to be the limit in use if the time for the parabolic antenna to be just opposite to the sun is not so long. On the other hand, the scattering angle is 55 degrees when the light collecting ratio is 0.015. Accordingly, the scattering angle has to be larger than the above value 55 degrees. The scattering angle was 10 degrees in the aforementioned samples which were mechanically polished. According to similar calculation, the temperature rises up to 2,000° C. when the light collecting ratio is 0.3. Since this temperature exceeds the melting point of aluminum (Al), the samples are not applicable.

In addition, in order to use also in high frequency, the RMS front-surface roughness has to be not larger than 10 $\mu$m all over the antenna panel which is of the order of 10 m. Therefore, when the antenna panel is finished, the warp (distortion) of the antenna panel has to be suppressed as small as possible. Even if a good mirror surface accuracy of the antenna panel can be obtained by machining before polishing, there may be a case that a predetermined mirror surface accuracy cannot be obtained after the front surface of the antenna panel is polished. Further, when a very high-precision antenna panel aimed at millimeter waves and submillimeter waves is manufactured and in order to finish the front surface of the antenna panel into a mirror surface with less "swell" by machining or the like, it is difficult to groove the mirror surface beforehand. In addition, it is very difficult to polish the curved surface of the antenna panel after the antenna panel is formed to have a mirror surface.

SUMMARY OF THE INVENTION

Therefore, the present invention was developed to solve the foregoing problems. It is an object of the present invention to provide a novel antenna system in which fine irregularities are formed on the front and back surfaces of an antenna panel by blasting so that the warp of the antenna panel can be reduced to ensure the front surface accuracy of the antenna panel while sunlight can be restrained from being collected; and to provide a method for manufacturing such an antenna system.

According to an aspect of the present invention, as stated in Aspect 1, an antenna system comprises an antenna panel which has fine irregularities on front and back surfaces thereof, the fine irregularities being formed by blasting so as to regularly reflect service radio waves having longer wavelength than sunlight and scatter sunlight.

Preferably, as stated in Aspect 2, in the antenna system according to Aspect 1, a chemical surface film is formed on the front surface of the antenna panel where the fine irregularities have been formed.

Preferably, as stated in Aspect 3, in the antenna system according to Aspect 1 or 2, the fine irregularities are in a range of from 0.1 μm to 1.0 μm in RMS front-surface roughness.

Preferably, as stated in Aspect 4, in the antenna system according to Aspect 2 or 3, the chemical surface film is formed by alodine processing.

Preferably, as stated in Aspect 5, in the antenna system according to Aspect 1 to 4, the chemical surface film is colorless.

According to another aspect of the present invention, as stated in Aspect 6, a method for manufacturing an antenna system in which an antenna panel is manufactured by combining a plurality of constituent parts, comprises the steps of: finishing front and back surface portions of each of the constituent parts so as to thin down the constituent parts; blasting the front and back surface portions of the constituent parts with abrasive grains after the finishing step so as to form fine irregularities on front and back surfaces of the antenna panel; combining the plurality of constituent parts subjected to the blasting step so as to form the antenna panel into a desired shape; and attaching an assistant reflecting mirror to the antenna panel acting as a main reflecting mirror.

Preferably, as stated in Aspect 7, the method according to Aspect 6 further comprises the step of applying surface treatment to the constituent parts subjected to the blasting step.

Preferably, as stated in Aspect 8, in the method according to Aspect 7, the surface treatment step is performed by application of alkali washing or acid washing.

DETAILED DESCRIPTION OF THE PREFERRED EMBODIMENTS (Embodiment 1)

Figure 1:
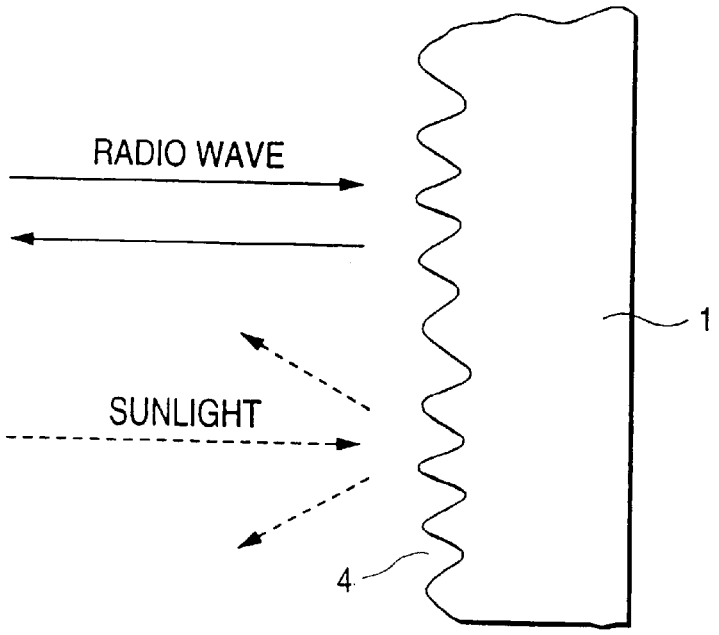
FIG. 1 is a schematically enlarged sectional view of the front surface of an antenna panel in an antenna system according to the present invention.

Embodiment 1 of the present invention will be described with reference to FIG. 1. FIG. 1 is a sectional view showing the front surface of an antenna panel 1 enlarged schematically. The antenna panel 1 is made of an aluminum alloy, and fine irregularities 4 are formed in the front and back surface portions of the antenna panel 1. As shown in FIG. 1, the antenna panel 1 is configured so that incident sunlight is irregularly reflected by the formation of the fine irregularities 4 in the front surface portion of the antenna panel 1 while service radio waves which are longer in wavelength than the sunlight are reflected regularly. The fine irregularities 4 are formed by blasting in which alumina abrasive grains (#400) are blasted on the front and back surface portions of the antenna panel 1 at a predetermined blast pressure, for example, about 0.2 MPa (Pa is a unit of pressure). The reason why blasting is performed on the front and back surface portions of the antenna panel 1 is that blasting prevents a warp of the antenna panel 1 from generating. Since blasting is performed by blasting abrasive grains onto the front surface of the antenna panel 1 to be finished, the fine irregularities 4 can be formed substantially uniformly all over the front surface of the antenna panel 1 no matter how curved the surface is.

(Embodiment 2)

Next, description will be made about a method for manufacturing an antenna panel according to Embodiment 1 of the present invention. The antenna panel 1 is constituted by combining a plurality of constituent parts. The respective constituent parts are made of an aluminum alloy, and set to be about 1 m square and about 30 mm thick. Each of the constituent parts has a predetermined radius of curvature in accordance with its own position in the antenna panel 1 so as to form a 10 m-order antenna panel. Each of the constituent parts is too heavy in weight if it is used as it is. Therefore, each of the constituent parts is thinned by machining its front and back surfaces by a machining center so as to be formed to be 2 to 3 mm thick. At this time, the front surface of the antenna panel 1 is restricted to be not larger than 10 μm in RMS. Then, alumina abrasive grains (#400) are blasted all over the back surface of each of the constituent parts as described above. At this time, the blast pressure of the alumina abrasive grains is set to be about 0.2 MPa. Similarly, alumina abrasive grains are blasted all over the front surface of each of the constituent parts. By blasting the front and back surfaces of each of the constituent parts thus, a warp which might be produced by blasting only the front surface is reduced.

For example, in an aluminum alloy plate which is 100 mm square and 2 mm thick, a warp of about 200 μm is produced if blasting is performed on only the front surface of each constituent part, while the warp can be reduced to be about 3 μm or less if blasting is performed on both the front and back surfaces. With this curvature, a warp exceeds 10 μm when the aluminum alloy plate is 1 m square. However, the antenna panel 1 is about 2 to 3 mm thick, that is, a little thicker than the aluminum alloy plate. Accordingly, there is no fear that the warp (distortion) due to blasting exceeds a predetermined value. Then, alodine processing is given to the respective constituent parts after blasting has been carried out on these parts, and the constituent parts are combined with one another in their predetermined positions. Thus, the front surface accuracy of the panel can be made not larger than about 10 μm in RMS front-surface roughness. Thus, the antenna panel 1 having a desired shape is constituted by a combination of the plurality of constituent parts. The assistant reflecting mirror 3 is attached to the antenna panel 1 acting as a main mirror so as to form a Large-size antenna system which is for the order of 10 μm.

Figure 2:
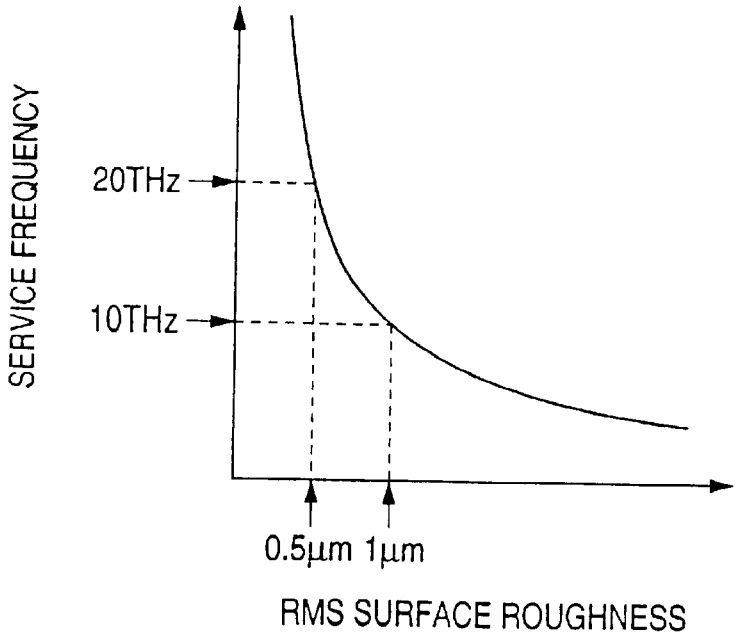
FIG. 2 is a characteristic graph showing the relationship between RMS front-surface roughness and service frequency of the antenna panel according to the present invention.
Figure 3:
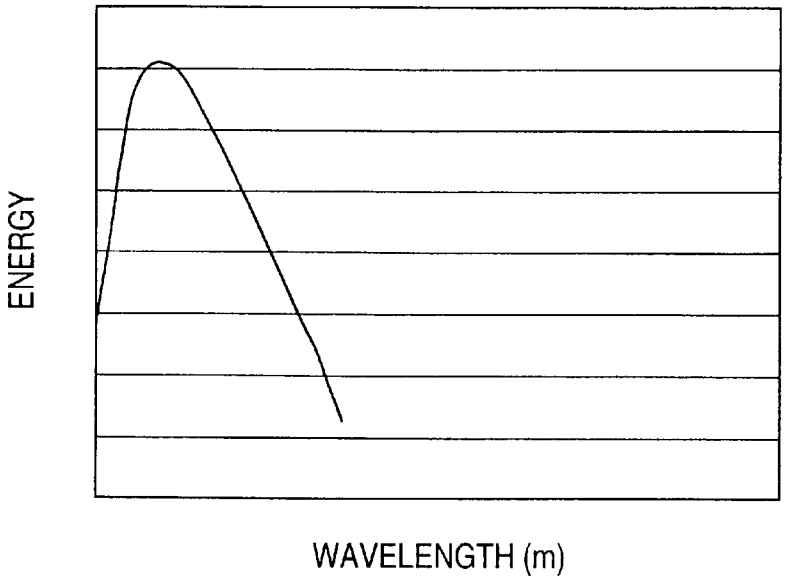
FIG. 3 is a characteristic graph of energy with respect to the wavelength of the antenna panel according to the present invention.

Further, Embodiment 2 of the present invention will be described with reference to FIG. 2. FIG. 2 is a characteristic graph showing the relationship between the RMS front-surface roughness on the antenna panel 1 and the service frequency of the antenna panel 1. As shown in FIG. 2, in order to make the service frequency available up to a high frequency of about 10 THz, it is necessary to make the antenna panel 1 not larger than 1 μm in RMS front-surface roughness. On the other hand, theoretically, light scattering is expressed by the equation (regular reflected light)/(total reflected light)=exp[−(4π Rrms/λ)2] if the incident angle is a right angle. That is, Rrms of about half a wavelength is required. In addition, as shown in FIG. 3, sunlight has the largest energy (J/m3s) at a wavelength (λ) in a range of from 0.4 μm to 0.6 μm. Accordingly, if the front surface roughness is not smaller than 0.1 μm which is ¼ of the wavelength, the regular reflected component becomes 1% or less of the total reflected light. Therefore, taking the light scattering and the service frequency into consideration, the front surface roughness is in a range of from 0.1 μm to 1 μm in RMS front-surface roughness.

Figure 4:
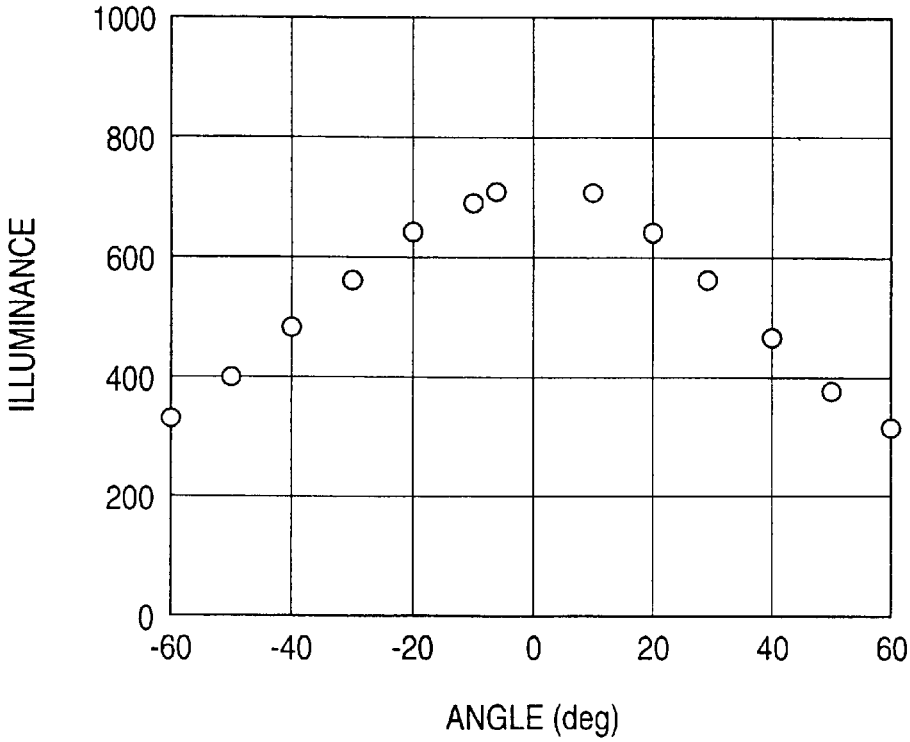
FIG. 4 is a sunlight reflecting characteristic graph in the case where blasting was performed on the front surface of the antenna panel according to the present invention.

Next, FIG. 4 is a sunlight reflection characteristic graph in the case where the front surface of an antenna panel is subjected to the aforementioned blasting. In this case, the RMS front-surface roughness is about 0.34 μm, and the half width (the width having half a peak value) is larger than 55° so that sunlight is considerably scattered on the front surface of the antenna panel. By scattering the sunlight thus, it is possible to restrain the assistant reflecting mirror 3 from rising in temperature.

Figure 5:
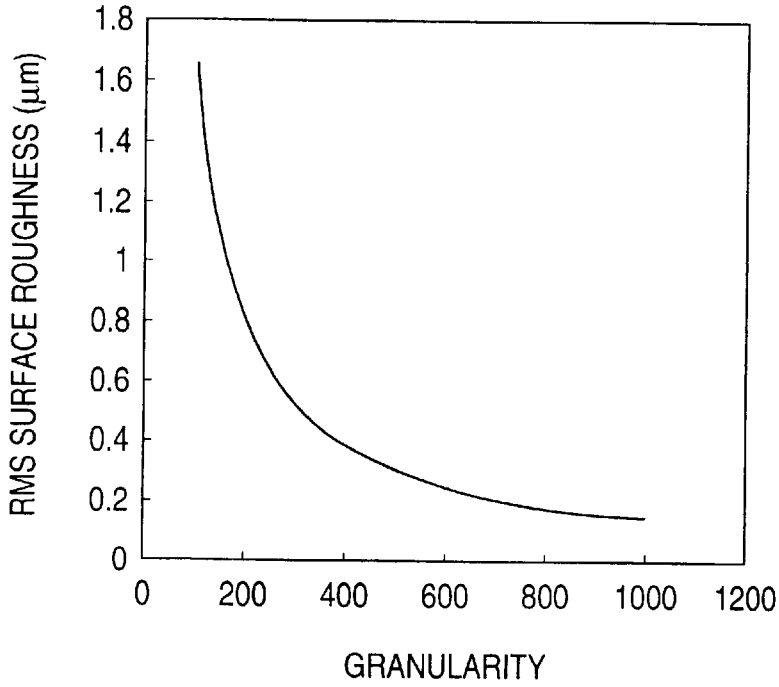
FIG. 5 is a characteristic graph showing the relationship between the granularity of alumina abrasive grains and RMS front-surface roughness on the antenna panel according to the present invention.
Figure 6:
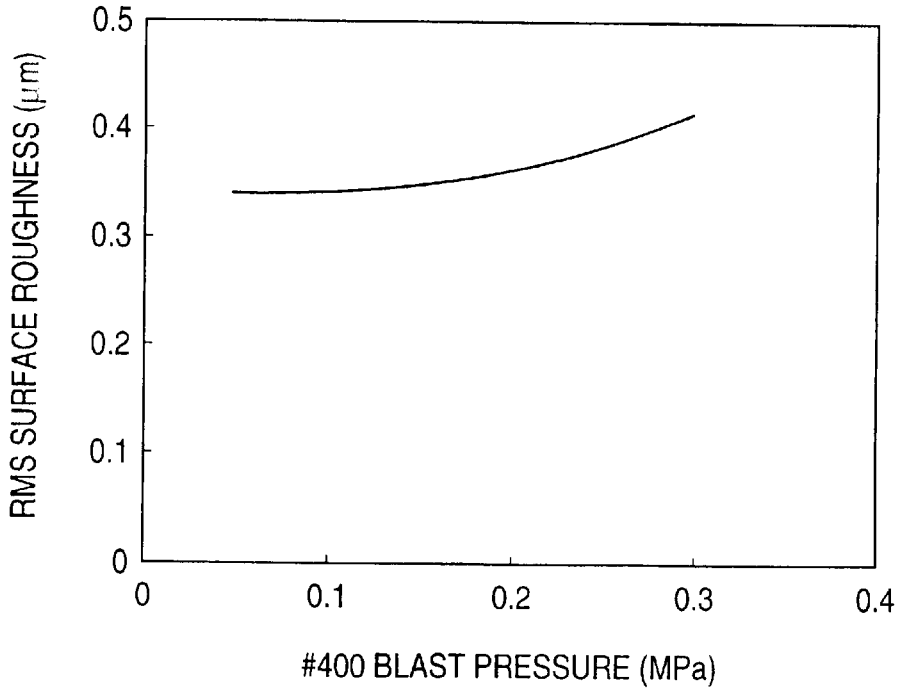
FIG. 6 is a characteristic graph of the antenna panel according to the present invention with respect to blast pressure.

Although the #400 alumina abrasive grains were used in the above description, abrasive grains are not limited thereto. Alumina abrasive grains other than #400 maybe used, or abrasive grains of ceramics, resin, or metal other than alumina may be used. FIG. 5 is a granularity characteristic graph showing the relationship between granularity of the #400 alumina abrasive grains and RMS front-surface roughness on the antenna panel. As shown in FIG. 5, the larger the abrasive grain size, the larger the RMS front-surface roughness. On the other hand, FIG. 6 is a characteristic graph of the RMS front-surface roughness with respect to blast pressure (MPa) of the #400 alumina abrasive grains. The blast pressure is not limited to the above-mentioned value 0.2 MPa. Further, there is a tendency that the warp of the antenna panel grows up as the front surface roughness thereof increases. However, if blasting is performed on the front and back surfaces of the antenna panel as described above, the warp can be reduced considerably. Accordingly, the blast pressure and the abrasive grain size can be established with reference to FIGS. 5 and 6 so that the fine irregularities 4 formed on the front surface of the antenna panel have RMS front-surface roughness in a range of from 0.1 μm to 1.0 μm. Further, blasting may be performed on each of the front and back surfaces of the antenna panel only once or a plurality of times.

The processing steps after the above-mentioned blasting are as follows. That is, an alkaline degreasing step, a light etching step by alkali (NaOH) washing, a desmutting step, and an alodine processing step are performed sequentially. Incidentally, water washing and so on are included in each step. If the chemical surface film 5 formed on the front surface of the antenna panel were colored for some reason, the sunlight absorptivity would increase so that the temperature of the antenna panel would increase. As a result, the antenna panel might deteriorate in accuracy and properties. It is therefore preferable that the chemical surface film 5 is colorless.

According to Embodiments 1 and 2 described above, millimeter waves entering the antenna panel 1 are reflected without scattering while keeping the incident angle. On the other hand, incident sunlight is irregularly scattered on the front surface of the antenna panel 1 without being collected, so that the assistant reflecting mirror 3 or stays are not affected by the reflected sunlight. In addition, because the chemical surface film 5 is provided by alodine processing on the front surface of the antenna panel 1, the antenna panel 1 can be formed to be rich in weatherability.

(Embodiment 3)

In Embodiment 3 of the present invention, blasting is performed on the front and back surfaces of an antenna panel 1 so as to provide fine irregularities 4 in the front and back surfaces in the same manner as in Embodiment 1 or 2. After the blasting is performed on the antenna panel 1, the antenna panel 1 is not subjected to such chemical surface film treatment as shown in Embodiment 1, but the antenna panel 1 is assembled after alkali washing or acid washing is performed. The aluminum front surface of the antenna panel 1 has to be covered with the chemical surface film 5 in the case where the antenna panel 1 is disposed outdoors to be exposed to the weather. However, there may be a case that the chemical surface film 5 need not be provided if the antenna panel 1 is disposed in a location where it rarely rains or there is little salt damage. In such a case, it will go well if alkali washing or the like is performed after blasting. On the other hand, if blasting were performed only on the front surface of the antenna panel 1, plastically deformed aluminum which is a raw material of the antenna panel 1 would get dark to absorb a part of sunlight without irregularly reflecting it. As a result, the temperature of the antenna panel 1 itself would rise to lower the antenna measurement accuracy. Therefore, alkali washing or the like is performed on the front surface of the antenna panel 1 so as to etch the front surface layer thereof slightly and eliminate dust and so on. Thus, the front surface of the antenna panel 1 becomes whitish enough to restrain the antenna panel 1 itself from rising in temperature.

Figure 7:
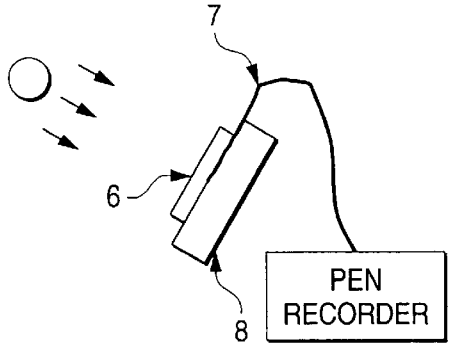
FIG. 7 is a schematic view of measuring equipment for measuring the situation of temperature rising of a sample according to the present invention.
Figure 8:
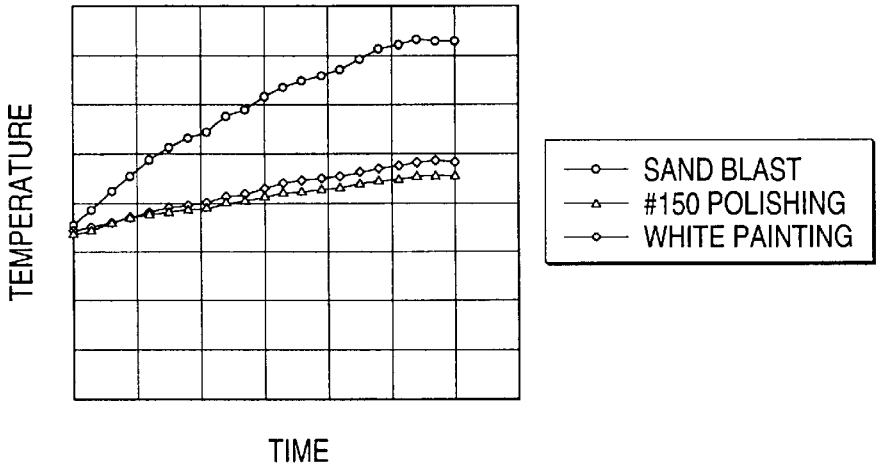
FIG. 8 is a temperature rising characteristic graph in the case where only processing of blasting was performed on a sample of an antenna panel according to the present invention.
Figure 9:
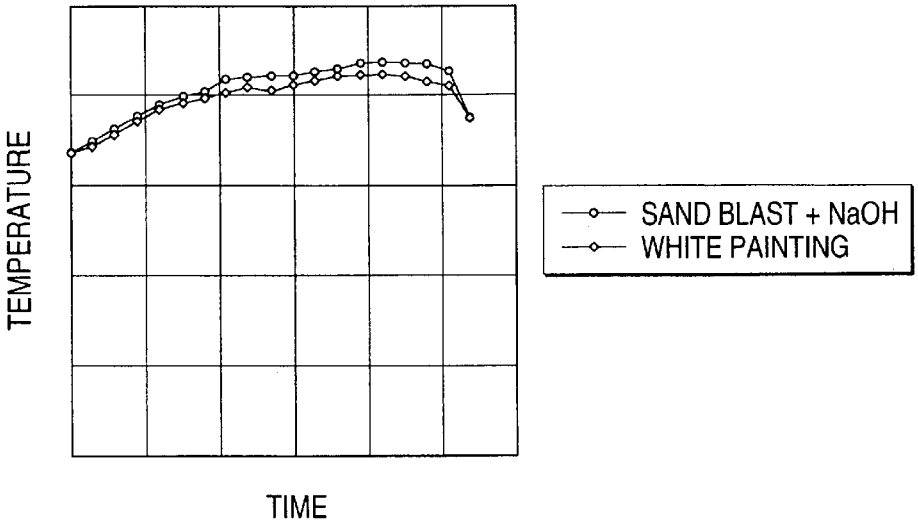
FIG. 9 is a temperature rising characteristic graph in the case where processing of alkali washing was further performed on the antenna panel according to the present invention.
Figure 10:
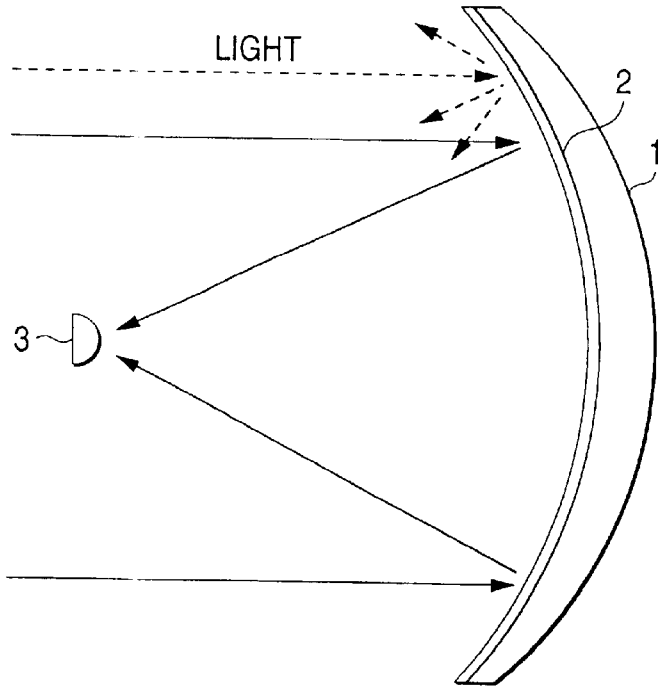
FIG. 10 PRIOR ART
FIG. 10 is a schematic view of a background-art antenna system.
Figure 11:
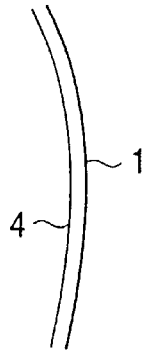
FIG. 11 is a typical sectional view of a background-art millimeter-wave antenna system.
Figure 12:
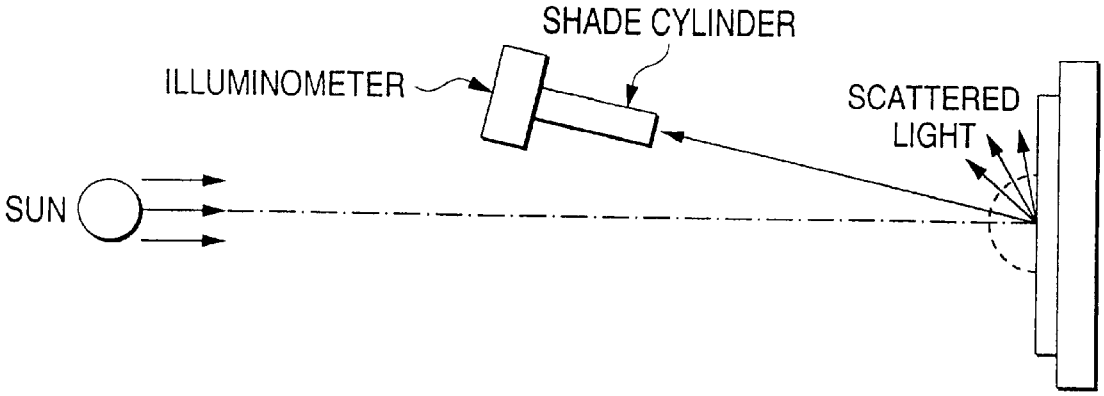
PRIOR ART FIG. 12 PRIOR ART
FIG. 12 is an explanatory view for explaining a method of measuring reflecting properties of the background-art antenna system.
Figure 13:
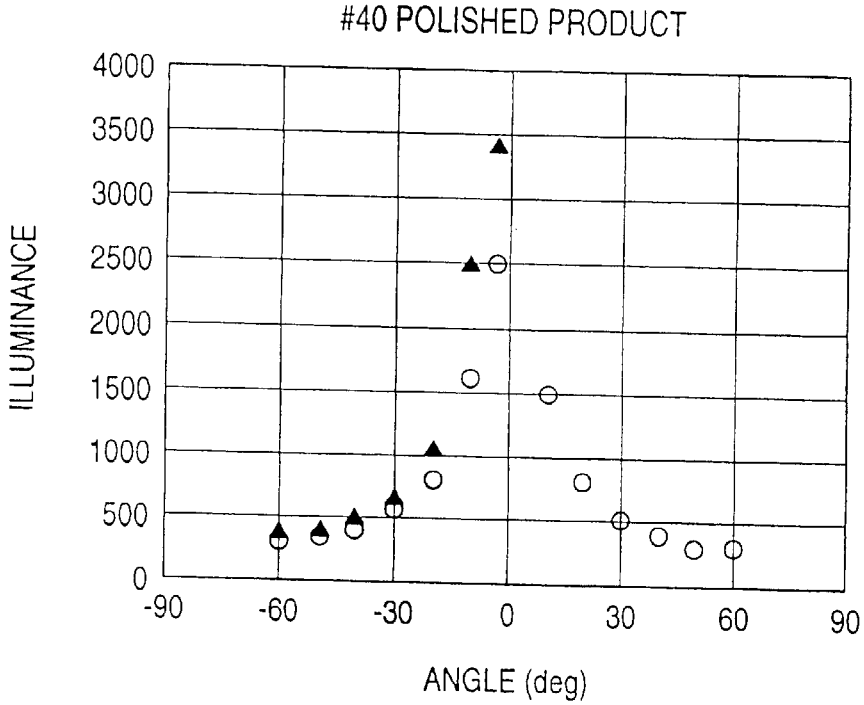
FIG. 13 PRIOR ART
FIG. 13 is a reflecting characteristic graph of one background-art antenna system.
Figure 14:
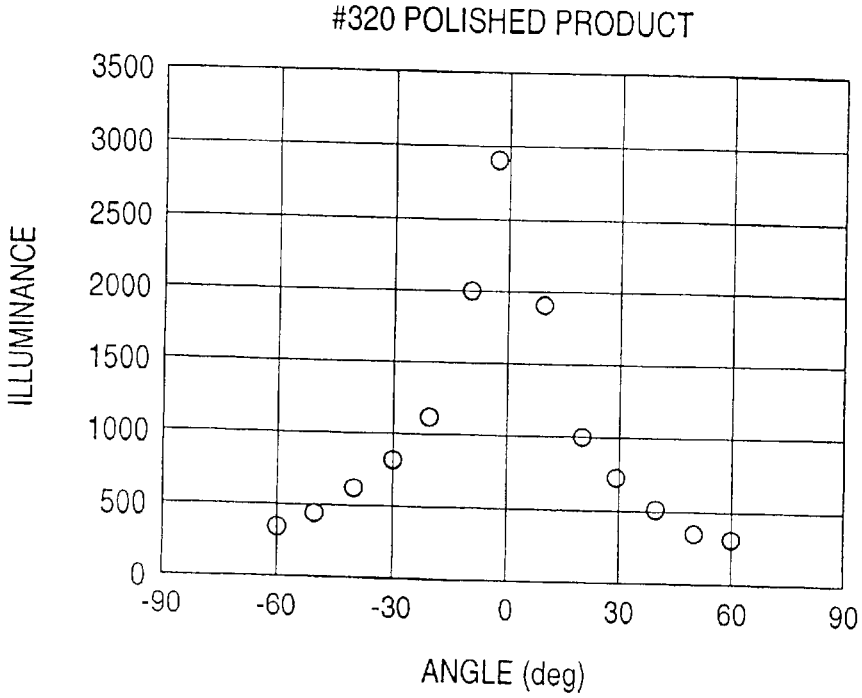
FIG. 14 PRIOR ART
FIG. 14 is a reflecting characteristic graph of another background-art antenna system.
Figure 15:
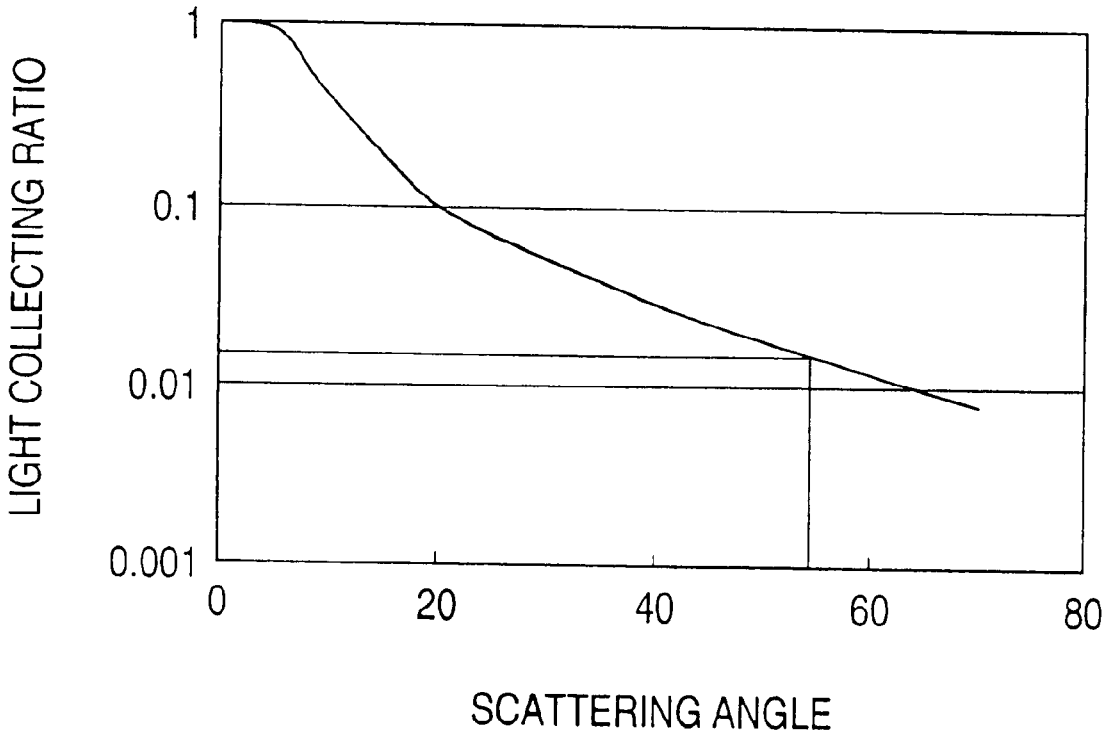
FIG. 15 PRIOR ART
FIG. 15 is a relationship graph showing the relationship between the ratio of scattered light collected on an assistant reflecting mirror disposed in a focus portion of a background-art large-size millimeter-wave parabolic antenna system and the scattering angle (half width).

Here, FIG. 7 is a schematic view of measuring equipment for measuring the situation of temperature rising of a sample 6. The sample 6 was an aluminum plate which was 200 mm square and 2 mm thick. A thermocouple 7 was attached to the back surface of the sample 6, and the back surface of the sample 6 was pasted on expanded polystyrene 8. The sample 6 was disposed so that the front surface thereof was substantially perpendicular to incident sunlight to thereby measure the temperature rising. Incidentally, because this measuring method was greatly affected by the wind or the weather at the time of measuring, a comparative sample (not shown) had to be set. FIGS. 8 and 9 are temperature rising characteristic graphs in the case where only processing of blasting was performed on the sample 6 and in the case where processing of alkali washing was further performed on the sample 6 after the blasting, respectively. It is understood from FIG. 8 that the temperature rising in the case where blasting was performed was larger than in the case of white painting or #150 polishing. It is also understood from FIG. 9 that the temperature rising in the case where alkali washing was further performed could be restrained to the same level as that in the case of white painting. Although alkali washing was adopted here, any other washing method or light etching may be adopted so long as it has an effect of removing dust, degeneration due to processing, or the like, adhering to the front surface of the sample 6.

According to an antenna system of the present invention, fine irregularities are formed on the front and back surfaces of an antenna panel by blasting so that the warp of the antenna panel can be reduced to ensure the front surface accuracy of the antenna panel while sunlight can be restrained effectively from being collected.

In addition, according to a method for manufacturing the antenna system according to the present invention, an antenna panel is manufactured by combining a plurality of constituent parts. The plurality of constituent parts are subjected to blasting so that fine irregularities are formed on the front and back surface portions of the respective constituent parts. The plurality of constituent parts subjected to blasting thus are combined to form an antenna panel having a desired shape. It is therefore possible to manufacture a high-precision large-size antenna system.

What is claimed is:

1. An antenna system comprising:

an antenna panel which has fine irregularities on front and back surfaces thereof, said fine irregularities being formed by blasting so as to regularly reflect service radio waves having longer wavelength than sunlight and scatter sunlight.

2. The antenna system according to claim 1, wherein a chemical surface film is formed on said front surface of said antenna panel where said fine irregularities have been formed.

3. The antenna system according to claim 2, wherein said chemical surface film is formed by alodine processing.

4. The antenna system according to claim 2, wherein said chemical surface film is colorless.

5. The antenna system according to claim 1, wherein said fine irregularities are in a range of from 0.1 $\mu$m to 1.0 $\mu$m in RMS front-surface roughness.

6. A method for manufacturing an antenna system in which an antenna panel is manufactured by combining a plurality of constituent parts, comprising the steps of:

finishing front and back surfaces of each of said constituent parts so as to thin down said constituent parts;

blasting said front and back surfaces of said constituent parts with abrasive grains after said finishing step so as to form fine irregularities on front and back surfaces of said antenna panel;

combining said plurality of constituent parts subjected to said blasting step so as to form said antenna panel into a desired shape; and attaching an assistant reflecting mirror to said antenna panel acting as a main reflecting mirror.

7. The method for manufacturing an antenna system according to claim 6, further comprising the step of:

applying surface treatment to said constituent parts subjected to said blasting step.

8. The method for manufacturing an antenna system according to claim 7, wherein said surface treatment step is performed by application of alkali washing or acid washing.

* * * * *